US006968718B2

(12) United States Patent
Imamura

(10) Patent No.: US 6,968,718 B2
(45) Date of Patent: Nov. 29, 2005

(54) METHOD FOR ELECTROMAGNETICALLY FORMING METALLIC MEMBER AND METALLIC MEMBER FORMED BY ELECTROMAGNETIC FORMING

(75) Inventor: Yoshihaya Imamura, Fujisawa (JP)

(73) Assignee: Kabushiki Kaisha Kobe Seiko Sho Kobe Steel, Ltd., Kobe (JP)

( * ) Notice: Subject to any disclaimer, the term of this patent is extended or adjusted under 35 U.S.C. 154(b) by 10 days.

(21) Appl. No.: 10/614,011

(22) Filed: Jul. 8, 2003

(65) Prior Publication Data

US 2004/0007038 A1 Jan. 15, 2004

(30) Foreign Application Priority Data

Jul. 9, 2002 (JP) ..... 2002-200386

(51) Int. Cl.[7] ..... B21D 26/14; B23P 17/00

(52) U.S. Cl. ..... 72/56; 72/54; 72/419.2; 72/430; 72/707

(58) Field of Search ..... 72/54, 55, 56, 72/419.2, 707, 430

(56) References Cited

U.S. PATENT DOCUMENTS 2,976,907 A * 3/1961 Harvey et al. ..... 72/56
3,345,732 A * 10/1967 Brower ..... 72/56
4,334,417 A * 6/1982 Victor ..... 72/56
4,947,667 A * 8/1990 Gunkel et al. ..... 72/56
5,634,364 A * 6/1997 Gardner et al. ..... 72/56
5,813,264 A * 9/1998 Steingroever ..... 72/56
5,826,320 A * 10/1998 Rathke et al. ..... 72/56
6,050,120 A * 4/2000 Daehn et al. ..... 72/54
6,484,384 B1 * 11/2002 Gibson et al. ..... 72/56
6,703,594 B2 * 3/2004 Yablochnikov ..... 72/56

FOREIGN PATENT DOCUMENTS

JP 61-63322 4/1986

OTHER PUBLICATIONS

Mechanical Engineering Laboratory Report No. 150, "Research of Plastic Forming Using Electromagnetic Force" (Mar., 1990, issued by Mechanical Engineering Laboratory).

* cited by examiner

*Primary Examiner*—David Jones
(74) *Attorney, Agent, or Firm*—Oblon, Spivak, McClelland, Maier & Neustadt, P.C.

(57) ABSTRACT

A method for electromagnetically forming a metallic member includes deforming an end of a metallic member by electromagnetic forming, pressing the outer surface of the deformed end on the surface of a mold to form a flange having a predetermined shape at the end of the metallic member and, at the same time, work-harden the flange. The method is capable of forming a flange having a shape corresponding to the shape of the outer surface of another member to be joined to the metallic member at an end of the metallic member with high dimensional accuracy and shape accuracy and secured joint strength.

15 Claims, 9 Drawing Sheets

METHOD FOR ELECTROMAGNETICALLY FORMING METALLIC MEMBER AND METALLIC MEMBER FORMED BY ELECTROMAGNETIC FORMING

BACKGROUND OF THE INVENTION

1. Field of the Invention

The present invention relates to a method of forming a metallic member, a joining metallic member, and a metallic member joint.

2. Description of the Related Art

In a joint using an aluminum alloy tube, a cross-joining type of tubular metallic member joint is generally used, in which tubular metallic members are crossed each other so that an end of one of the tubular metallic member is joined to a surface of the other tubular metallic member. However, such a cross-joining type of aluminum alloy tube joint has a difficult in securing, particularly, bonding (joining) strength and joint strength as the diameter of each of the tubes or tubular members increases.

If a flange having a saddle-like curved surface or the like can be freely formed at the tube end of the aluminum alloy tube to conform with the outer surface shape of another tube material to be bonded at the aluminum alloy tube joint, bonding is facilitated, and joint strength is easily secured.

It has been proposed to apply an electromagnetic forming technique for forming such a flange. The electromagnetic forming technique is a technique for plastically forming or shaping of a workpiece into a predetermined shape by a method in which electric energy (electric charge) stored at a high voltage is input (discharged) into a current-carrying coil in a moment to form a strong magnetic field for a very short time, and thus a work (a work piece or metallic member) placed in the magnetic field is plastically deformed at a high speed by a strong expansive force or contractive force due to the repulsive force (Lorentz force according to the Fleming's left-hand rule) of the magnetic field.

For a metallic member such as a metal plate or tube having high conductivity and easily causing an eddy current, the electromagnetic forming technique has been conventionally considered promising for forming a plate, expanding a tube, contracting a tube, joining tubes, forming a tube end, etc. Particularly, an aluminum alloy is a good electric conductor, and is thus considered as a material suitable for the electromagnetic forming.

However, an electromagnetic method of forming the above-described flange at an end of an aluminum alloy tube has not yet been put into practical use. This is because the coil used for the electromagnetic forming has a short life due to a delay of development in an apparatus. However, particularly, tube expansion such as expansion of an end of an aluminum alloy tube has a problem of large difficulty in forming, as compared with tube contraction in which the diameter of a tube used for caulking is decreased.

Particularly, the above-described aluminum alloy tube joint is required to have high dimensional accuracy and shape accuracy over the entirety of the joint. Free tube expansion without using a mold such as a metal mold or the like cannot be put into practical use because an expanded portion formed by the electromagnetic forming method has low dimensional accuracy. Namely, in conventional electromagnetic forming of an end of an aluminum alloy tube by free tube expansion, a defect of the shape easily occurs as the diameter of the aluminum alloy tube increases and the size of the flange to be formed increases. Therefore, the flange having satisfactory dimensional accuracy and shape accuracy cannot be formed.

Therefore, in Mechanical Engineering Laboratory Report No. 150 "Research of Plastic Forming Using Electromagnetic Force" (March, 1990, issued by Mechanical Engineering Laboratory), it is proposed that tube expansion using a mold such as a metal mold or the like is required for integrally forming a flange with satisfactory dimensional accuracy and shape accuracy at an end of an aluminum alloy tube by electromagnetic forming. The electromagnetic forming method of Mechanical Engineering Laboratory Report No. 150 will be described in detail below with reference to FIG. 1.

However, even when the end of the aluminum alloy tube is expanded by using the mold, as described in Mechanical Engineering Laboratory Report No. 150, the formed flange has not very high dimensional accuracy and shape accuracy even by using a relatively thin plate of about 1 mm in thickness or a relatively narrow aluminum alloy tube having an inner diameter of less than 50 mmΦ.

Also, in the tube expansion of the end of the aluminum alloy tube by using the mold, the end of the aluminum alloy tube collides with the mold by expansion, thereby causing the problem of inevitably decreasing the thickness of the formed flange. This phenomenon tends to increase as the diameter of the aluminum alloy tube and the size of the flange formed increase. When the thickness of the formed flange decreases, joint strength deteriorates at the aluminum alloy tube joint in which the edge of the flange is joined by welding or a mechanical means. In welding, a thermal effect increases the deterioration in the joint strength.

Furthermore, in order to satisfy the dimensional accuracy and shape accuracy of the formed flange and suppress a reduction in thickness, another means can also be considered, in which the mold such as a metal mold or the like is used, and electromagnetic forming is performed stepwisely by a plurality of times of discharge of a current-carrying coil, not one time of discharge. However, in this case, the aluminum alloy is softened by the heat generated by repeated uses of the current-carrying coil to cause the problem of decreasing the strength. Also, a plurality of times of discharge of the current-carrying coil is expensive and deteriorates the process efficiency, and thus this method is not said to be practical. Therefore, in the actual situation, an electromagnetic method of forming the above-described flange at the end of the aluminum alloy tube has not yet been put into practical use.

SUMMARY OF THE INVENTION

The present invention has been achieved in consideration of the above problems, and an object of the present invention is to provide an electromagnetic method capable of freely and efficiently forming a flange at an end of a metallic member to have a shape according to the outer surface of another member to be joined, improving the dimensional accuracy and shape accuracy of the formed flange, and securing joint strength, a joining metallic member, and a joint.

In order to achieve the object, the gist of a forming method for a metallic member of the present invention lies in an electromagnetic forming method for a metallic member comprising deforming an end of a metallic member by electromagnetic forming, pressing the outer surface of the deformed end on the surface of a mold to form a flange having a predetermined shape at the end of the metallic member and, at the same time, work-harden the flange.

In the present invention, for example, an end of a metallic tubular member is expanded (widened) by electromagnetic forming using the mold. The principle of the method is basically the same as that of the method described in Mechanical Engineering Laboratory Report No. 150.

In the tube expansion, the thickness of the flange formed at the end of the metallic member is inevitably decreased. However, the present invention is greatly different from the method described in Mechanical Engineering Laboratory Report No. 150 in that the flange is work-hardened to increase strength during a series of electromagnetic forming steps of deforming the end of the metallic member and pressing the outer surface of the deformed end on the surface of the mold, thereby compensating for a reduction in strength due to a reduction in thickness of the flange and securing joint strength.

Therefore, the present invention has the effect of forming the flange having the outer surface shape conforming with the outer surface shape of another member to be joined at the end of the metallic member by electromagnetic forming, to improve the dimensional accuracy and shape accuracy and secure the joint strength.

Furthermore, the present invention is capable of completely forming the flange by only one time of electromagnetic forming including work hardening, and thus has the effect of efficiently forming the flange.

DESCRIPTION OF THE PREFERRED EMBODIMENTS

Figure 1:
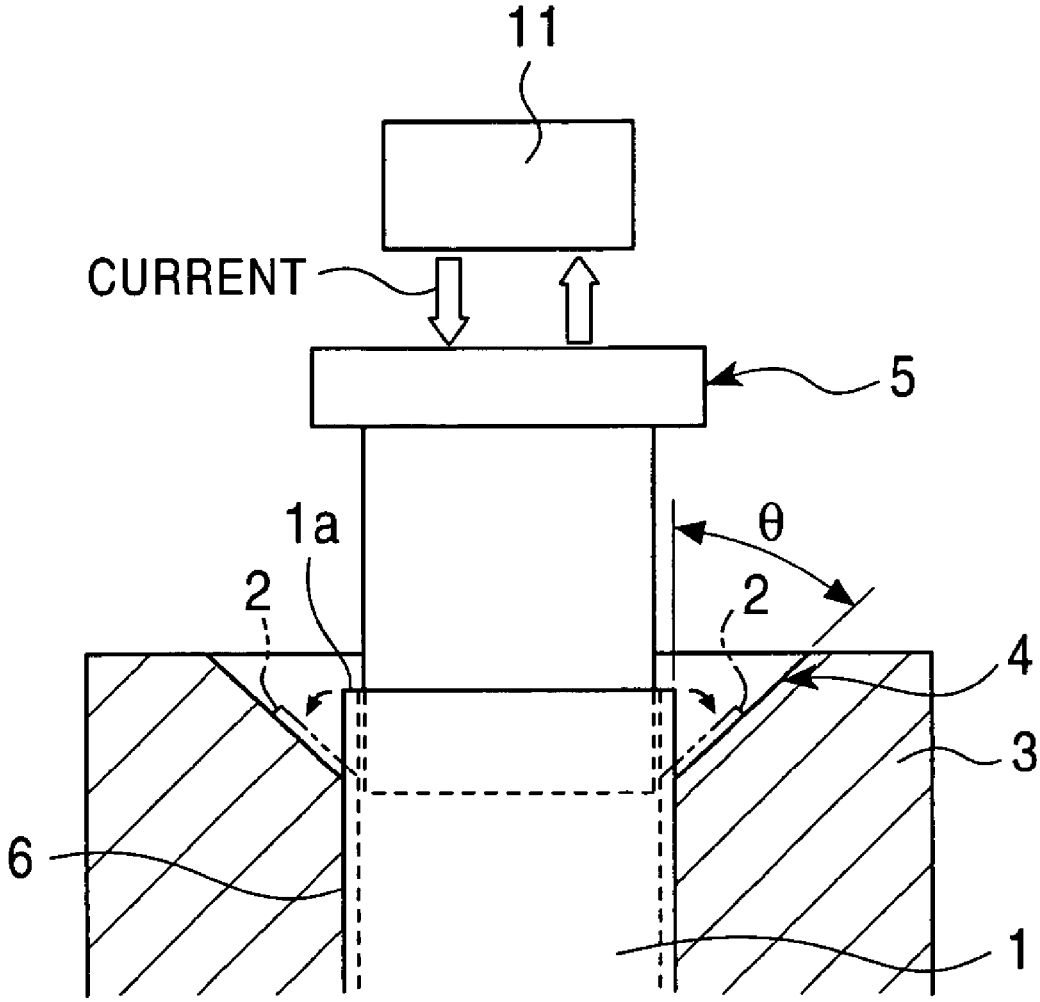
FIG. 1 is a schematic drawing illustrating the principle of tube expansion (widening) of a tube end by electromagnetic forming using a mold according to the present invention.

An embodiment of the present invention will be described in detail below.

(Joining Metallic Member)

In the present invention, a joining metallic member means a member to be joined to another member by any one of various means through a flange formed at the end of one of the members to form a joint or the like. Therefore, the joining metallic member does not include a metallic member not to be joined to another member.

Since a primary object of the present invention is to expand an aluminum alloy tube by electromagnetic forming, the metallic member preferably has a tubular shape. Also, the metallic member is preferably composed of an aluminum alloy.

(Object Metal)

In the present invention, as a metal of the metallic member to be subjected to electromagnetic forming, an aluminum alloy member or copper or copper alloy member, which is suitable for electromagnetic forming, which has high conductivity, and which easily causes an eddy current required for electromagnetic forming, is used. On the other hand, a processing-resistant member composed of steel, stainless steel, titanium or the like, which has low conductivity, which causes less eddy current, and which is not suitable for electromagnetic forming, cannot be subjected directly to electromagnetic forming. Therefore, in the present invention, the processing-resistant member of any one of these metals is not included directly in the range of electromagnetic forming.

However, the aluminum alloy member or copper or copper alloy member may be disposed on the electromagnetic coil side of the processing-resistant member composed of steel, stainless steel, titanium or the like so that the processing-resistant member can be deformed by electromagnetic forming (deformation) of the aluminum alloy member or copper or copper alloy member disposed on the electromagnetic coil side to indirectly shape the processing resistant member. In this case, the aluminum alloy member or copper or copper alloy member is referred to as a "driver". Therefore, the present invention includes forming of the processing resistant member by using the driver.

(Shape of Applicable Member)

In the present invention, the shape of the metallic member is not limited. In other words, forming is basically possible regardless of the shape of the member. However, the present invention is mainly applied to members having shapes such as a plate, a tube, and the like. As described above, the primary object of the present invention is to expand an aluminum alloy tube by electromagnetic forming. However, a member having a shape other than a tube can be formed by the means of the present invention, and has the same problem as that of a tubular member. Also, a member having the shape of a plate, a tube, or the like and composed of a metal other than an aluminum alloy, for example, copper having high conductivity and easily causing an eddy current required for electromagnetic forming, can be formed by the means of the present invention, and has the same problem as that of an aluminum alloy.

(Tubular Member)

In the present invention, the tubular member includes hollow shape materials having closed sectional shapes such as a circle, an ellipse, other undefined circular shapes, and the like, and shape materials having open sectional shapes such as a C-like shape, a U-like shape, and the like. These shape materials (sections) need not be integrally formed by extrusion or the like, and these materials may include a welded tube formed by welding a formed plate. The plate member and tubular member other than the tube may be formed by the means of the present invention, and have the same problem with a joint as that of the tube.

Expansion of the end of the aluminum alloy tube will be described in detail below with reference to the drawings. As described above, the present invention is not limited to this case.

FIG. 1 schematically shows the principle of expansion (widening) of a tube end in which a flange is integrally formed at an end of an aluminum alloy tube by expansion of the tube end of the aluminum alloy tube using electromagnetic forming. In FIG. 1, reference numeral 1 denotes an aluminum alloy tube disposed vertically so that the lower end is fixed to the ground; reference numeral 1*a*, a tube end to be expanded; reference numeral 4, a funnel-like forming surface widening outward and provided in a mold 3 for forming the flange; reference numeral 2, a funnel-like flange to be formed; reference numeral 5, a current-carrying coil; and reference numeral 11, an impulse current generator.

In FIG. 1, the mold 3 comprises a through hole 6 having a larger diameter than that of the aluminum alloy tube 1 so that the aluminum alloy tube 1 is inserted into the through hole 6 in the upward direction in the drawing. In this case, the tube end 1*a* to be expanded is projected into the funnel-like forming surface 4 by a length corresponding to the size of the flange 2 to be formed. Then, the current-carrying coil 5 is inserted into the aluminum alloy tube 1 from the tube end 1*a* (the upper portion of the drawing). The length of insertion of the current-carrying coil 5 into the tube also corresponds to a length of the tube corresponding to the size of the flange 2 to be formed.

Then, the electric energy stored at a high voltage in the impulse current generator 11 is supplied to the current-carrying coil 5 in a moment to generate an eddy current at the tube end 1*a* and form a strong magnetic field at the tube end 1*a* for a very short time. As a result, the tube end 1*a* placed in the magnetic field is subjected to a strong expansive force due to the repulsive force of the magnetic field to be plastically deformed at a high speed, thereby expanding in the peripheral direction shown by arrows in FIG. 1. The expanded tube end 1*a* is pressed on the funnel-like forming surface 4 by a strong force to form the funnel-like flange 2 at the end of the aluminum alloy tube 1. A series of the electromagnetic forming steps is performed in a moment at a high working speed of several hundreds m/s or more.

In this electromagnetic forming, a great impulsive force exceeding the elastic limit of the metallic member is required for imparting high-speed plastic deformation to the metallic member. Therefore, the impulse high-current generator 11 utilizing a capacitor is used for controlling the electromagnetic force required for working by controlling the amount of electric energy (amount of electric energy input to the coil) stored in the capacitor. In order to increase the amount of the electric energy input at a time, the capacity of the capacitor may be increased by a necessary amount. By using the impulse high-current generator 11, the electric energy can be supplied in a moment, and thus a great impulsive force can be applied to the metallic member.

The discharge condition of the current-carrying coil 5 is selected so as to form the flange 2 having satisfactory dimensional accuracy and shape accuracy by a series of the electromagnetic forming steps comprising expanding the tube end and pressing the surface of the expanded tube end on the mold surface. Also, the discharge condition of the current-carrying coil 5 is selected so as to work-harden a portion including the flange 2 by a series of the electromagnetic forming steps comprising expanding the tube end and pressing the surface of the expanded tube end on the mold surface. Work hardening for compensating for a reduction in thickness cannot be realized unless there are the discharge condition described below and pressing on the mold surface.

The amount of work hardening for compensating for a reduction in thickness depends upon a reduction in thickness, material characteristics or forming conditions such as the amount of the electric energy input. When an electric energy of 8 kJ or more is supplied for expanding the tube end of the aluminum alloy tube, a reduction in thickness generated by one time of electromagnetic forming is in the range of about 5 to 20%. In this case, the 0.2% yield strength and hardness must be improved by 60% or more and 25% or more, respectively, based on those of a tube before forming.

When the tube end of the aluminum alloy tube having a relatively large thickness or large bore diameter is expanded by the electromagnetic forming of the present invention, the amount of the electric energy supplied is preferably controlled to 8 kJ or more in one time of electromagnetic forming in which the tube end of the metallic member is expanded at room temperature, and the outer surface of the expanded tube end is pressed on the mold surface to form the flange having a predetermined shape at the end of the metallic member, and at the same time, to work-harden the flange.

With the electric energy of less than 8 kJ, even when the electric energy is divided and supplied (the electromagnetic forming step) several times to the tubular metallic member such as the aluminum alloy tube having a relatively large thickness or large bore diameter, a flange having satisfactory dimensional accuracy and shape accuracy cannot be formed at the end of the metallic member because the electric energy supplied to the current-carrying coil at one time is small. Also, a reduction in strength due to a reduction in thickness of the flange cannot be compensated for by work-hardening a portion including the formed flange.

For example, with the electric energy of less than 8 kJ, the electromagnetic forming of the present invention cannot be achieved for an aluminum alloy or copper metallic member such as a tube having an inner diameter of as large as 50 mmΦ or more necessary for constructional materials or a large plate having a length (width) of 50 mm or more and a wall thickness (plate thickness) of 3 mm or more necessary for constructional materials. In other words, the electromagnetic forming cannot be performed for forming a flange having satisfactory dimensional accuracy and shape accuracy and compensating for a reduction in strength due to a reduction in thickness of the flange by work-hardening a portion including the flange, thereby failing to secure the joint strength.

For the aluminum alloy tubular member having a large inner diameter of 50 mmΦ or more, the amount of the necessary electric energy supplied slightly varies with thickness. With a thickness of 3 mm, the amount of the necessary electric energy supplied is about 8 to 15 kJ depending upon the type of the aluminum alloy used and thermal refining (heat treatment). With a thickness of 5 mm, the amount of the necessary electric energy supplied is about 13 to 40 kJ, and with a thickness of 8 mm or less, the amount of the necessary electric energy supplied is about 45 to 80 kJ. However, a larger amount of supplied electric energy is required for 7000-series aluminum alloys having highest strength. For example, with a thickness of 3 mm, the necessary electric energy is about 40 kJ, with a thickness of 5 mm, the necessary electric energy is about 60 kJ, and with a thickness of 8 mm or less, the necessary input electric energy is about 100 kJ.

From this viewpoint, a difficulty in tube expanding by a conventional electromagnetic forming using the mold described in Mechanical Engineering Laboratory Report No. 150 is due to the fact that the electric energy input at a time is a level of as low as about 3.2 kJ because of a limitation of the current-carrying coil.

In the present invention, a series of the electromagnetic forming steps is preferably performed for the metallic member at a normal temperature (electromagnetic forming at a normal temperature) for preventing softening of the formed metallic member and promoting work hardening. However, the normal temperature includes room temperature, and a temperature rise without causing softening is allowed. If the satisfactory shape accuracy can be attained, and the about-described amount of work hardening can be secured, electromagnetic forming can be performed at a high temperature or a low temperature including an ultra-low temperature according to the material used and the shape of the member.

On the other hand, preferred conditions of the metallic member to be formed include the conductivity and the sectional shape of a portion to be formed. In the present invention, the metallic member having a sectional shape with no small-diameter corner, such as a rectangular or prismatic shape, is preferred. When the metallic member to be formed has a corner with a small corner angle (R), both sides of the expanded corner overlap with each other to cause collision with each other, thereby easily producing wrinkles in the flange and possibly developing a crack from the wrinkles. Therefore, the tubular member is preferably a hollow material having a closed sectional shape such as a circle, an ellipse, another undefined circle without a small-angle corner, or the like, or a material having an open sectional shape such as a C-like shape, a U-like shape, or the like. In other words, there is no constraint condition of the sectional shape of the metallic member to be formed except the absence of the small-diameter corner, and thus the present invention has the advantage of freedom that a member having any sectional shape can be corrected by pressing on the forming surface of the mold to form a flange having a desired shape.

Furthermore, the shape of the cut end of the metallic member, which is formed into the flange, corresponds to the shape of the flange. Namely, in order to form such a flange as shown in FIG. 1 or FIGS. 11A, 11B or 11C, the shape of the cut end of the metallic member corresponds to the shape of the flange. On the other hand, in order to form such an oblique flange (inclined from the vertical direction in FIG. 2) as shown in FIG. 2, the cut end of a metallic member is formed in such an oblique cut end (inclined from the vertical direction in the drawing) as shown in a perspective view of FIG. 3A or 3B.

Description will now be made of a method of actually forming the flange 2 having such a saddle-like curved surface as shown in FIG. 2 at the tube end 1*a* of the aluminum alloy tube 1. The flange 2 has a shape conforming with the shape of the outer surface of another metallic member to be joined to the aluminum alloy tube 1 as a metallic member.

Figure 2A:
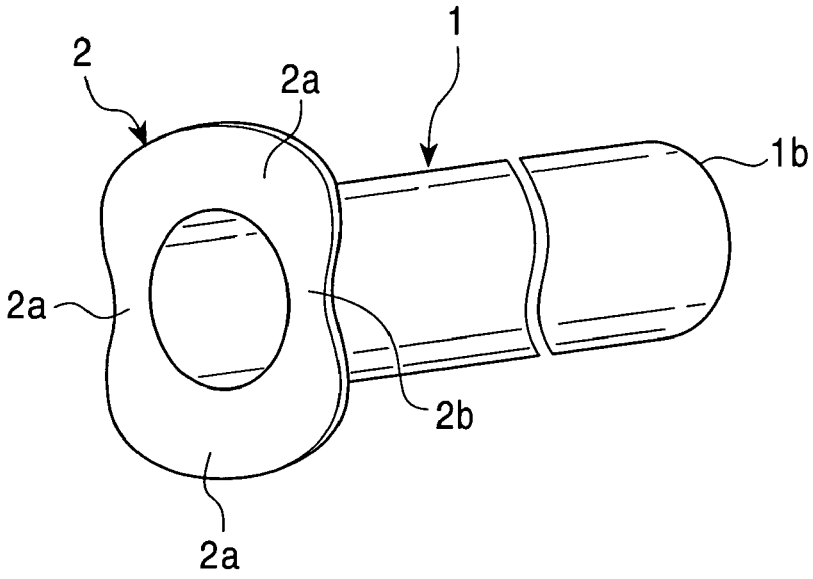
FIGS. 2A and 2B are a perspective view and front view, respectively, each showing an example of an aluminum alloy tube having a flange formed at an end according to an embodiment of the present invention.
Figure 2B:
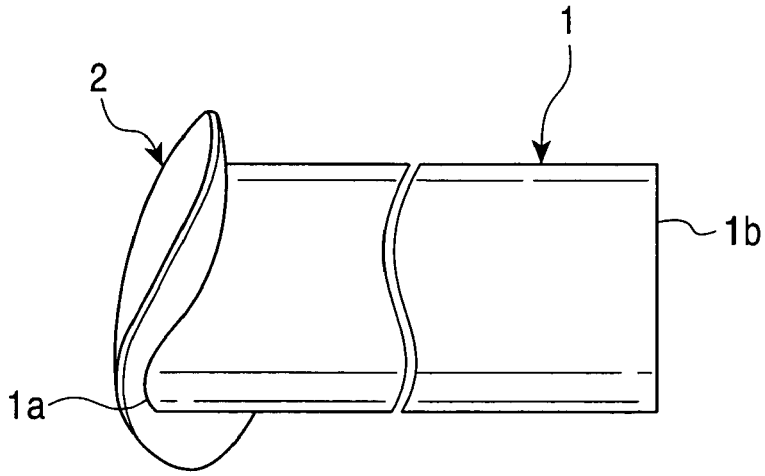

FIGS. 2A and 2B are a perspective view and a front view, respectively, each showing a state in which the flange 2 is formed only at the tube end 1*a* of the aluminum alloy tube 1. The flange 2 may be formed at the other tube end 1*b* of the aluminum alloy tube 1 to provide the flanges at both ends of the aluminum alloy tube 1.

The flange 2 shown in FIG. 2 has a shape having a saddle-like curved surface comprising long parts 2*a* in the longitudinal direction of the drawing, and short parts 2*b* in the transverse direction of the drawing. The flange 2 having such a saddle-like curved surface is optimum for joining both tubes from the viewpoint that the flange 2 can be fitted into the shape of the outer surface of another metallic tubular member to be joined, as shown in FIG. 10 described below, and a joint between both tubes can be simply formed. The directions of the long parts 2*a* and the short parts 2*b*, and the shape of the curved surface can be appropriately selected according to, for example, the direction of the stress applied to the joint or the joining means selected.

Besides the flange 2 having the saddle-like curved surface which has not been formed so far, of course, flanges each having a simple flat shape or flat surface, for example, the flanges shown in FIG. 1 and FIGS. 11A, 11B and 11C which have different inclination angles can be formed. In other words, in the present invention, the shape of the flange can be freely selected according to the shape of the outer surface of the other member to be joined to the flange. From this viewpoint, the flange surface is not necessarily a flat surface, and if required, embossed irregularities, recessed grooves, projecting stripes, or the like may be provided on the flange for imparting shape rigidity to the flange. By providing irregularities on the forming surface of the mold corresponding to these irregularities, the irregularities can be formed at the same time as the electromagnetic forming.

Figure 4:
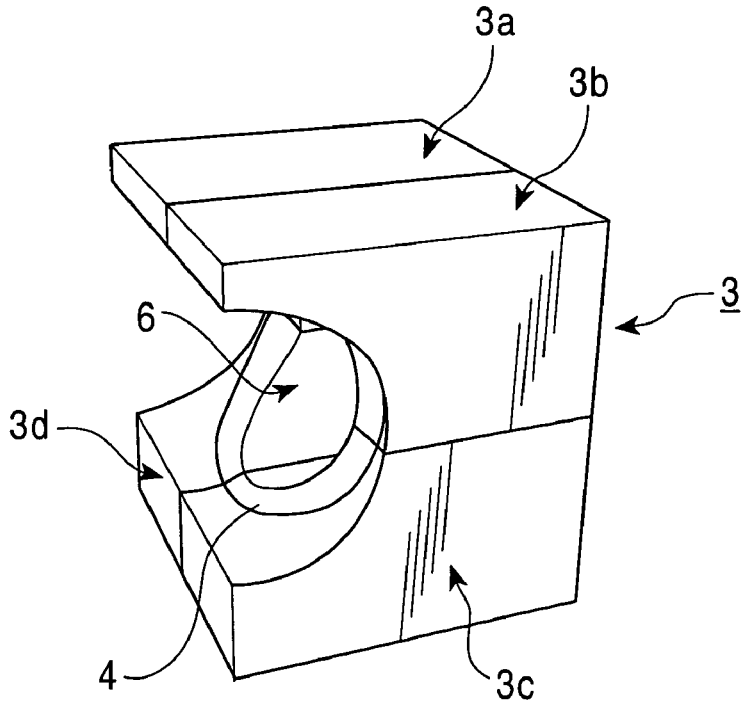
FIG. 4 is a perspective view showing a mold used in an embodiment of the present invention.

FIG. 4 is a perspective view showing an example of a mold actually used for forming the flange 2 shown in FIG. 2 at the tube end 1*a* of the aluminum alloy tube 1. In FIG. 4, the mold 3 is divided into (four parts) two upper parts 3*a* and 3*b* and lower parts 3*c* and 3*d*, not the integral type shown in FIG. 1. In setting the aluminum alloy tube 1 in the mold 3, the aluminum alloy tube 1 is set at a portion corresponding to the through hole 6 in the state in which the mold 3 is separated into the four parts including the upper parts 3*a* and 3*b* and the lower parts 3*c* and 3*d*, and then the upper parts 3*a* and 3*b* and the lower parts 3*c* and 3*d* are combined together to set the aluminum alloy tube 1. The forming surface 4 of the mold 3 has the saddle-like shape corresponding to the shape of the (inner) surface of the flange 2 shown in FIG. 2.

With the integral-type mold 3 shown in FIG. 1, the direction of insertion of the tubular member into the mold is limited to deteriorate workability, and in some cases, the tubular member cannot be separated from the mold after forming according to the expanding conditions for the tubular member and the conditions for pressing on the forming surface of the mold. On the other hand, the mold comprising the four parts or two parts (halves) can facilitate setting of the tubular member in the mold, and permits the tubular member to be easily separated from the mold after forming regardless of the expanding conditions for the tubular member and the conditions for pressing on the forming surface of the mold.

Figure 3A:
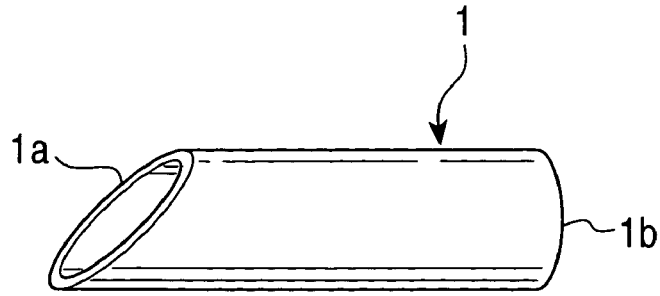
FIGS. 3A and 3B are perspective views showing other examples of a shape of a cut end of a metallic member.
Figure 3B:
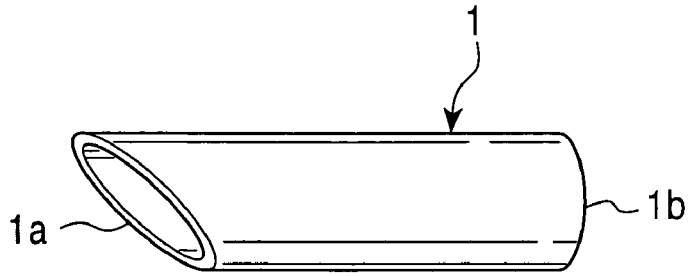

Electromagnetic forming was performed for the aluminum alloy tube 1 having the oblique cut end shown in FIG. 3A by using the mold shown in FIG. 4 and the current-carrying coil shown in FIGS. 5 and 6, as described below.

The 5000-series aluminum alloy tube 1 under JIS standards to be formed (an extruded tube annealed and then cooled, having a 0.2% yield strength of 115 MPa and a hardness of 70 HV) had an outer diameter of 70 mmΦ (an inner diameter of 63 mmΦ and a wall thickness of 3.5 mm).

On the other hand, the through hole 6 of the mold 3 had a diameter of 72 mmΦ (a clearance of 2 mm between the mold and the tube) lager than the outer diameter of the aluminum alloy tube 1. The flange to be formed had the same saddle-like shape as that of the flange 2 shown in FIG. 2, in which the flange height (length) was set to 30 mm, the total length of the long parts 2*a* of the saddle-like shape was set to 140 mm, the curvature of the long parts 2*a* was set to 40 mm, the total length of the short parts 2*b* was set to 75 mm, and the curvature of the short parts 2*b* was set to 40 mm.

Figure 7:
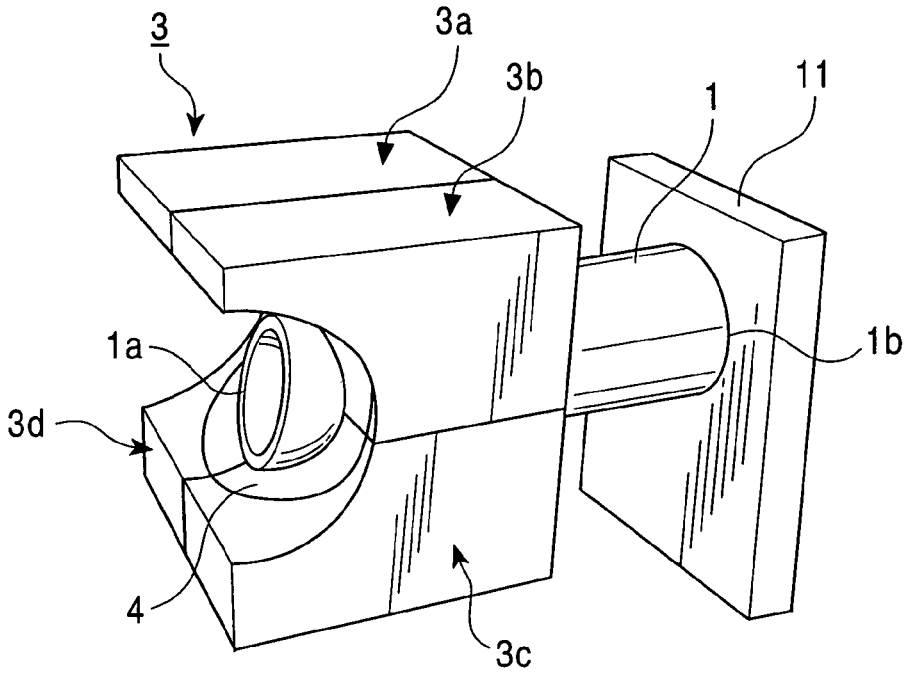
FIG. 7 is a perspective view showing a forming state in an embodiment of the present invention.

First, as shown in a perspective view of FIG. 7, the aluminum alloy tube 1 was set in the through hole 6 of the divided mold 3 horizontally arranged, as described above. In this step, the tube end 1*a* to be expanded was projected into the forming surface 4 of the mold 3 by a length of 5 to 30 mm corresponding to the size of the flange to be formed.

Figure 8:
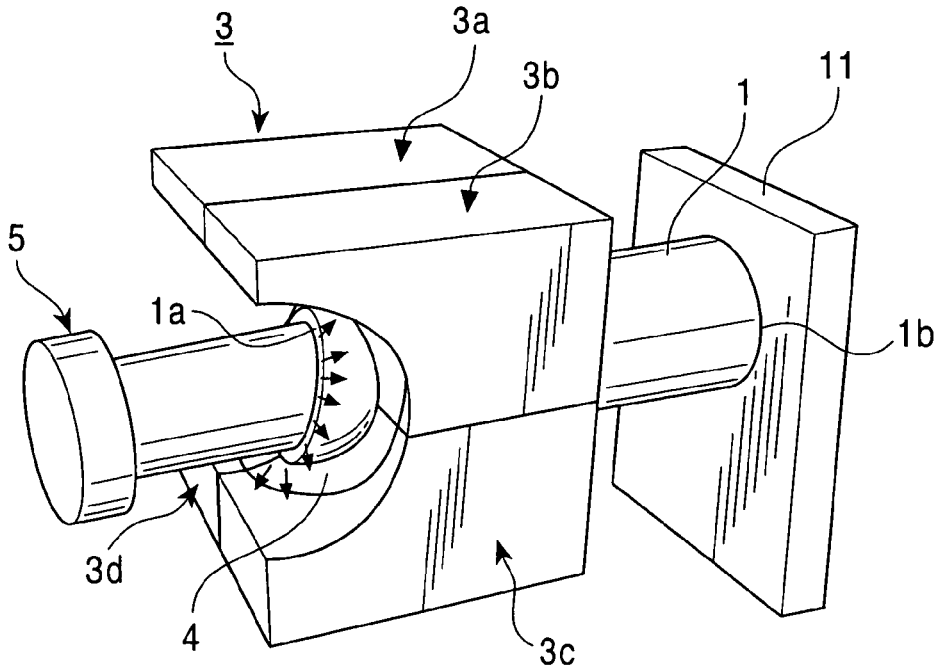
FIG. 8 is a perspective view showing a forming state in an embodiment of the present invention.

Then, as shown in a perspective view of FIG. 8, the current-carrying coil 5 was inserted into the aluminum alloy tube 1 from the tube end 1*a* (the left side of the drawing). The length of insertion of the current-carrying coil 5 into the tube 1 was also set to a length corresponding to the size of the flange 2 to be formed. Then, 30 kJ (600 μF, 10 kV) of electric energy stored at a high voltage in the impulse current generator not shown in the drawing was input to the current-carrying coil 5 in a moment to form a strong magnetic field at the tube end 1*a* for a very short time, thereby expanding the tube end 1*a* in the peripheral direction shown by arrows in FIG. 8.

Figure 9:
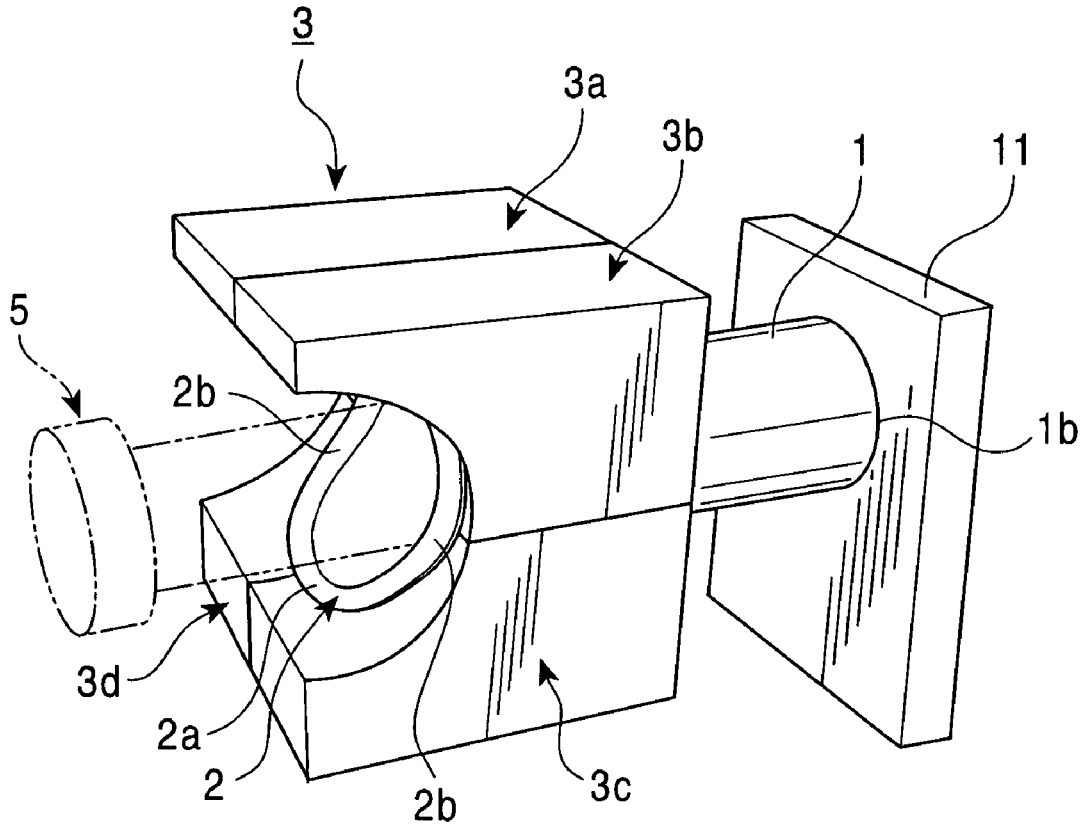
FIG. 9 is a perspective view showing a forming state in an embodiment of the present invention.

Then, as shown in a perspective view of FIG. 9, the expanded tube end 1*a* was pressed on the saddle-like forming surface 4 by a strong force to form the flange 2 (having the long parts 2*a* and the short parts 2*b*) shown in FIG. 2 at the end of the aluminum alloy tube 1.

In this embodiment, electromagnetic forming was performed for the aluminum alloy tube positioned horizontally (substantially horizontally). Also, in the electromagnetic forming, the other end 1*b* of the tubular member (aluminum alloy tube 1) was fixed by a presser plate (abutting plate) 11. In the horizontal electromagnetic forming, a load is applied in the axial direction by an electromagnetic force, and thus the position of the aluminum alloy tube 1 is possibly deviated (to the rightward direction of the drawing) to adversely affect the dimensional accuracy and shape accuracy of the flange. Therefore, in the horizontal electromagnetic forming, the aluminum alloy tube 1 is preferably positioned or fixed. Besides the presser plate 11, a known method such as clamping of the tube, knurling of the tube contact surface of the mold, or the like may be appropriately used as the fixing method. In the vertical electromagnetic forming shown in FIG. 1, the lower end of the aluminum alloy tube is fixed to a base or the ground.

The horizontal electromagnetic forming of the aluminum alloy tube 1 has higher workability than that of the vertical (substantially vertical) electromagnetic forming of the aluminum alloy tube 1 shown in FIG. 1, and is thus suitable for continuous electromagnetic forming of a plurality of aluminum alloy tubes 1 to be formed. In the vertical electromagnetic forming of the aluminum alloy tube 1 shown in FIG. 1, the length of the tube is limited by the problem of support, while in the horizontal electromagnetic forming, the length of the aluminum alloy tube 1 can be further increased.

Figure 12A:
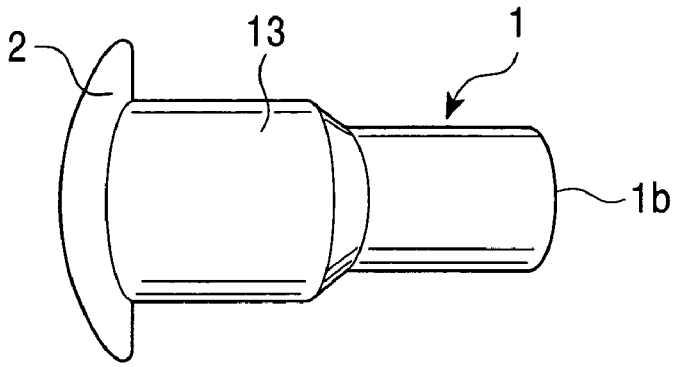
FIGS. 12A and 12B are perspective views showing examples of a joint of an aluminum alloy tube according to an embodiment of the present invention.
Figure 12B:
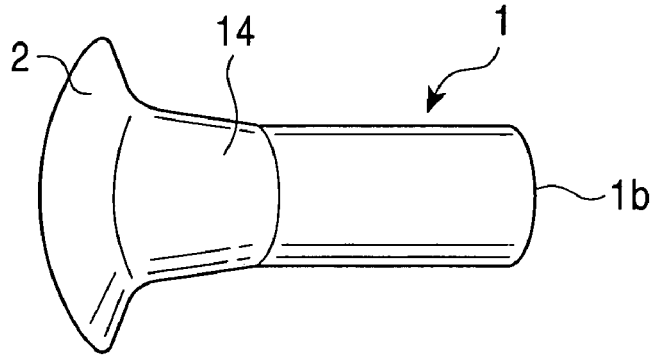

After the forming, a substantially parallel widened portion 13 was formed at the rear of the formed flange 2 of the aluminum alloy tube 1 in the length direction, as shown in a perspective view of FIG. 12A. The widened portion 13 had an outer diameter of 76 mm and a length of 100 mm. The substantially parallel widened portion 13 shown in FIG. 12A or the tapered widened portion 14 shown in a perspective view of FIG. 12B can be simply provided by controlling the clearance between the through hole 6 (outer surface) of the mold and the outer diameter of the aluminum alloy tube 1.

Furthermore, the widened portion can be work-hardened at the same time the widened portion is formed at the rear of the flange of the metallic member to compensate for a reduction in strength due to a reduction in thickness of the flange, thereby securing the joint strength.

Namely, with the clearance of zero for the flange forming portion of the tube end 1*a*, the widened portion is basically not formed. Also, when the clearance for the flange forming portion of the tube end 1*a* is provided to gradually increase in the length direction of the tube, the tapered widened portion 14 shown in FIG. 12B can be formed. While, when the clearance is constant in the length direction of the tube, the substantially parallel widened portion 13 shown in FIG. 12A can be formed. The clearance can be controlled by using the mold 3 divided into the upper parts 3*a* and the lower part 3*b*. However, the integral-type the mold shown in FIG. 1 requires a clearance for inserting the tube, and thus cannot be controlled so as not to form the widened portion with a clearance of zero.

As a result of surface observation of the saddle-like flange 2 formed as described above, the surface (outer surface of the flange) at the joint with the other tube is a smoothly curved surface necessary for this type of joint surface without flaws, irregularities and wrinkles. In this way, the forming method of the present invention is capable of finishing the outer surface (joint surface) of the flange out of contact with the mold to, particularly, a smooth and glossy surface, and thus the forming method can be used for shaping of a plate material, for example, edge working (hem working) of a vehicle body outer panel or the like in which the outer surface of the flange faces outward.

Also, with respect to the dimensional accuracy and shape accuracy of the flange, a dimensional error of the flange height was within the range of ±1 mm, an error of the total length of the long parts 2*a* of the saddle shape was in the range of ±1.5 mm, an error of curvature of the long parts 2 was in the range of ±0.3 mm, an error of the total length of the short parts 2*b* was in the range of ±1.0 mm, and an error of curvature of the short parts 2*b* was in the range of ±0.25 mm, relative to the designed shape of the saddle-like flange.

Figure 10A:
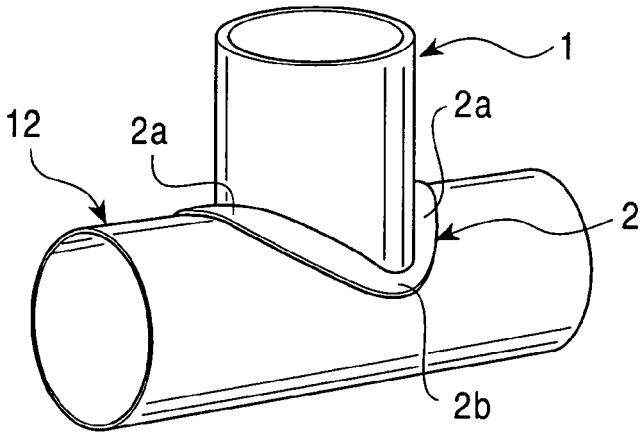
FIGS. 10A, 10B and 10C are a perspective view, a side view and a front view, respectively, each showing an example of an aluminum alloy tube joint formed in an embodiment of the present invention.
Figure 10B:
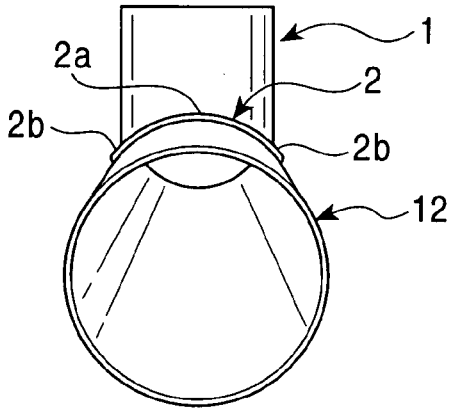
Figure 10C:
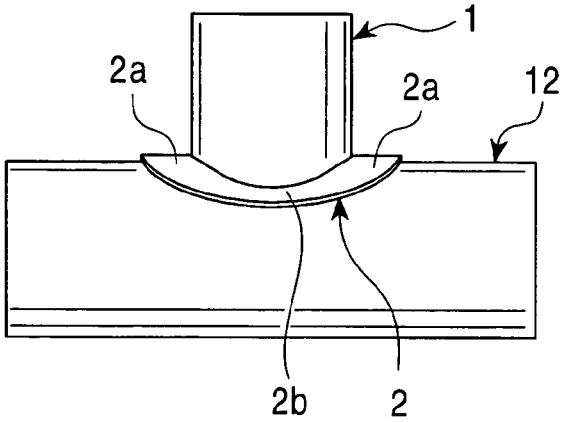

These error levels indicate that the long parts 2*a* and the short parts 2*b* of the addle-like flange 2 are finely fitted to the outer surface of the other tube 12 without any space, as shown in a perspective view of FIG. 10A, a side view of FIG. 10B and a front view of FIG. 10C which show the state of a joint. This means that the flange has excellent dimensional accuracy and shape accuracy as a joint member for another tube.

Therefore, in this embodiment, the aluminum alloy tube 1 can be fitted to the shape of the outer surface of the other tube 12 through the formed saddle-like flange 2 to form a joint between both tubes. Then, the periphery of the flange 2 is welded to prevent or suppress the thermal effect on the end (root portion) of the aluminum alloy tube 1 which dominates the joint strength. Also, both tubes can be mechanically joined together through the flange 2, and the joining means can be freely selected.

The metallic member formed in the forming method for the metallic member of the present invention has the flange formed at its end by expanding and work hardening, and is thus optimum as a joining metallic member to be joined to another metallic member through the flange.

In the use of the joining metallic member, the periphery of the flange is preferably joined to the other metallic member by welding. Also, in the use of the joining metallic member, the joining metallic member is preferably used as a metallic member joint to be joined to the other metallic member through the flange. Furthermore, both the metallic members are preferably tubular.

Furthermore, the average thickness of the end of the formed saddle-like flange 2 was 2.9 mm, and thus the thickness was inevitably reduced by 0.6 mm, as described above. On the other hand, the saddle-like flange 2 had an average 0.2% yield strength in the radial direction of 250 MPa, and a hardness of 100 HV, and the widened portion 13 had an average 0.2% yield strength in the length direction of 240 MPa an a hardness of 90 HV. Therefore, the 0.2% yield strength and hardness were improved by 43% and 29%, respectively, by work hardening in comparison with those of a tube before forming. The amount of work hardening is sufficient to compensate for a reduction in strength due to a reduction in thickness of the flange and secure the joint strength.

For a comparison, electromagnetic forming was performed under the same conditions as described above except that the input electric energy was decreased to 7 kJ lower than 8 kJ. As a result, the tube end was not curved to a pressing position of the mold, thereby failing to form a saddle-like flange.

As the aluminum alloy used in the present invention, 3000-series, 5000-series, 6000-series, and 7000-series aluminum alloys and the like which are generally used for this type of constructional material and which are defined by AA or JIS standards are preferred because they have both high formability and high strength. Particularly, Al—Mg—system 5000-series aluminum alloys are preferred from the viewpoint of a large amount of work hardening in electromagnetic forming and high formability. Also, Al—Mg—Si-system 6000-series aluminum alloys are preferred from the viewpoint of artificial age hardenability (bake hardenability), ease of forming with low yield strength, and the ability to increase yield strength by artificial age hardening. Of course, other aluminum alloys can be subjected to electromagnetic forming, and the aluminum alloy can be selected according to the application and required characteristics.

Although the use of the aluminum alloy tube is described above, members having other shapes such as an aluminum alloy plate and the like, elongated materials such as an extruded material, a rolled material, a forged material, and the like, or a cast material may be used. Furthermore, another copper or copper alloy member can be applied to electromagnetic forming under modified design conditions in which the shape of the mold is changed, or under the same conditions as those for the aluminum alloy tube.

A preferred example of the current-carrying coil used in the embodiment will be described below. FIG. 5 is a sectional view showing a preferred example of the current-carrying coil used in the embodiment. FIG. 6 is an enlarged view of a principal portion of the current-carrying coil 4 shown in FIG. 5.

As disclosed in Japanese Unexamined Patent Application Publication Nos. 7-153617 and 6-238356, a coil conventionally used for electromagnetic tube expanding has a structure in which a copper wire having a circular section is wound around an axial core composed of an insulating resin, and the spaces of the copper wire are filled with an insulating resin. However, as described above, the life of the current-carrying coil is important for the electromagnetic forming of the present invention, and thus the current-carrying coil having the form shown in FIGS. 5 and 6 described below is preferred for improving the life of the current-carrying coil.

Figure 5:
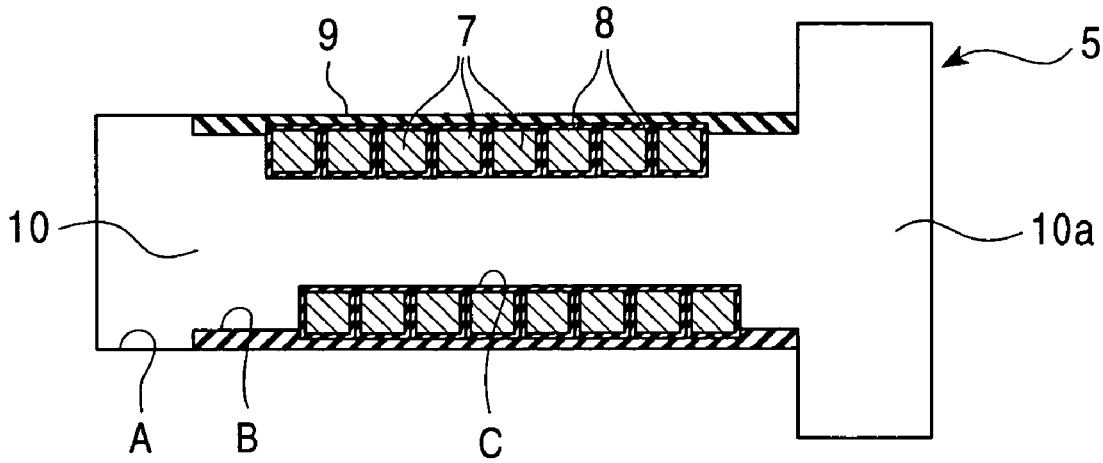
FIG. 5 is a sectional view showing a conductor element wire of a current-carrying coil used in an embodiment of the present invention.
Figure 6:
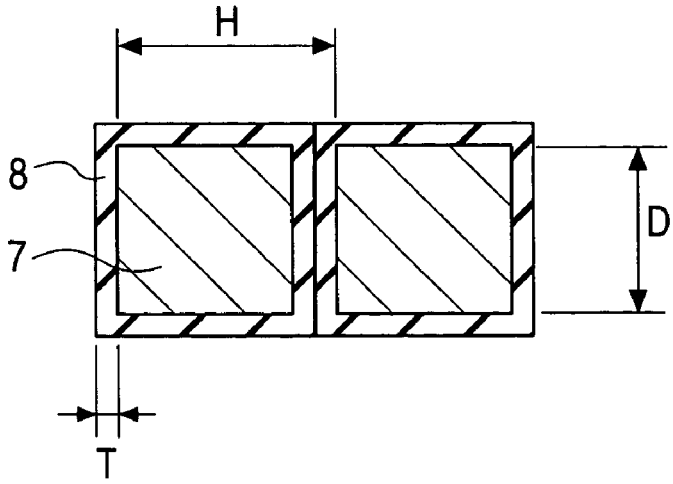
FIG. 6 is an enlarged sectional view showing the principal portion shown in FIG. 5.

In FIGS. 5 and 6, a bobbin 10 made of an insulating resin corresponds to the core of the current-carrying coil 5, and has a flange 10*a* provided at the base end. A necessary-length portion at the front end of the bobbin 10 is inserted into the aluminum alloy tube 1 as a workpiece. The bobbin 10 inserted comprises an intermediate-diameter portion B having an intermediate outer diameter, a minimum-diameter portion C having the minimum outer diameter, an intermediate-diameter portion B having an intermediate outer diameter, and a maximum-diameter portion A having the maximum outer diameter are formed adjacent to each other on the periphery of the bobbin 10 in the axial direction from the base end to the front end of the coil. Furthermore, a step is formed by a difference between the outer diameters of the intermediate-diameter portion B near the front end and the maximum-diameter portion A adjacent to each other, and two steps are formed by differences between the outer diameters of the minimum-diameter portion C and the respective intermediate-diameter portions B.

On the other hand, a conductor element wire 7 of the coil has a square (or rectangular) sectional shape having a side length D. The conductor element wire 7 is coated with an insulating material 8 for insulating the conductor. The conductor element wire 7 is tightly wound in a layer on the minimum-diameter portion C of the bobbin 10. Namely, the conductor element wire 7 is wound on the periphery of the minimum-diameter portion C so as to be fitted into a recess formed between the two steps between the minimum-diameter portion C and the two intermediate-diameter portions B, and thus the conductor element wire 7 is closely wound without any space, as shown in FIGS. 5 and 6. Therefore, assuming that the thickness of the insulating material 8 coated on the conductor wire 8 is T, the winding pitch H of the conductor element wire 7 in the axial direction of the coil is 2T.

Furthermore, an insulator 9 is coated on the outer surface of the wound conductor element wire 7 and the intermediate-diameter portions B. The insulator 9 is fixed to the outer surface of the conductor element wire 7 and the peripheries of the intermediate-diameter portions B so as to be fitted into a recess formed between the step and the flange 10*a*. In this way, the insulator 9 is coated on the conductor element wire 7 and the intermediate-diameter portions B, and has such a thickness that the outer surface of the insulator 9 is coplanar with the periphery of the maximum-diameter portion A.

As described above, the conductor element wire 7 of this example is insulated by coating the insulating material 8 on the periphery of the conductor element wire 7. The insulating material 8 preferably comprises a fiber-reinforced resin comprising glass fibers impregnated with an epoxy resin. By using the fiber-reinforced resin as the insulating material 8, the periphery of the conductor element wire 7 is reinforced to prevent or decrease deformation of the conductor element wire 7 under a strong expansive force in electrification of the coil.

Also, the conductor element wire 7 has parallel wire surfaces corresponding to the sectional form and is wound on the bobbin 10 so that the winding pitch H of the conductor element wire 7 is 2T assuming that the thickness of the insulating material 8 is T. Therefore, the thickness of the insulating layer on the conductor element wire 7 is uniform, and the insulating layer comprises only the reinforced insulating material 8. Thus, even when an expansive force is applied to the coil by electrification, the force is dispersed to decrease a breakage of the insulating layer.

Furthermore, in the state in which the conductor element wire 7 is spirally wound, the conductor element wire 7 has parallel surfaces, thereby causing no place for deteriorating insulation due to the entrance of unnecessary vacancies during resin impregnation.

The conductor element wire 7 may have any one of a rectangular shape, a square shape, and the like as long as the conductor wire 7 can maintain the parallel surfaces when wound on the bobbin 10. Particularly, a square shape is preferred because the sectional shape is less deformed by winding.

Furthermore, the peripheral insulator 9 is fixed to the recess formed between the step and the flange 10*a*, and thus the peripheral insulator 9 insulates the conductor element wire 7 from a workpiece and covers the conductor element wire 7 to maintain it by coating. Therefore, the peripheral insulator 9 has the function to prevent the conductor element wire 7 from being outwardly expanded and deformed by a great force applied when large energy is input.

Also, the coil of this example has a structure causing substantially no space in winding the conductor element wire 7, and thus the peripheral insulator 9 can mainly prevent thermal expansion of the conductor wire 7 and maintain the conductor element wire 7 on the periphery of the bobbin 10 by the clamping force of the insulator 9. Also, the peripheral insulator 9 is strongly fixed to the bobbin 10 by the steps provided at the end of the bobbin 10, thereby causing the effect of stabilizing the conductor element wire 7 when a large energy is input. The width (length in the axial direction of the coil) of the step is preferably 10 mm or more for strongly fixing the outer insulator 9.

As described above, the coil of this example has parallel adjacent surfaces when the conductor wire is spirally wound, and only the insulating material is present in the spaces of the conductor element wire, thereby decreasing deformation of the conductor element wire in electrification and preventing a breakage of the insulating layer of the conductor element wire. Furthermore, insulation does not deteriorate due to the entrance of unnecessary vacancies in resin impregnation. Since the peripheral insulator is securely disposed, insulation between the conductor element wire and the workpiece can be attained, and the conductor element wire can be prevented from being outwardly expanded and deformed by a force applied at the time of electrification.

Figure 13:
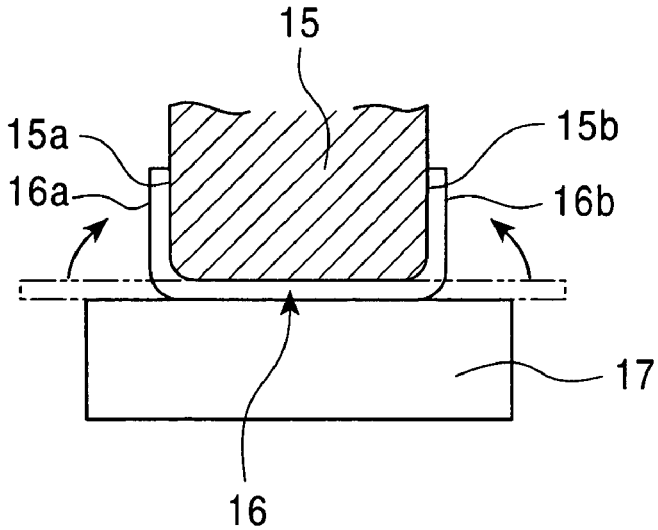
FIG. 13 is a sectional view showing a case in which the end of an aluminum alloy plate is bent according to another embodiment of the present invention.

Electromagnetic forming of the tubular metallic member is mainly described above. Electromagnetic forming of a metallic plate member will be described below. FIG. 13 is a sectional view showing a case in which, for example, both ends 16*a* and 16*b* of an aluminum alloy plate 16 are bent in the width (length) direction. The bending position is appropriately selected, and only one end may be partially bent in the width (length) direction. In FIG. 13, reference numeral 15 denotes a mold, and reference numeral 17 denotes a plate-shaped current-carrying coil. Also, a coil is wound in a spiral planar shape on the plate-shaped current-carrying coil to cover the working surfaces at both ends of the aluminum alloy plate 16.

In FIG. 13, electric energy stored at a high voltage in an impulse current generator not shown in the drawing is input to the current-carrying coil 17 to form a strong magnetic field at both ends 16*a* and 16*b* for a short time. As a result, both ends 16*a* and 16*b* are deformed to be bent upward, as shown by arrows in FIG. 13.

In this step, both deformed ends 16*a* and 16*b* are pressed on forming surfaces 15*a* and 15*b*, respectively, of the mold 15 by a strong force to form a L-shaped flange bent at 90° at either end of the aluminum alloy plate 16, and at the same time, the flanges are work-hardened. Therefore, a reduction in strength due to a reduction in thickness of the flange can be compensated for, and the occurrence of the problem of spring back, which is caused by, particularly, bending of an aluminum alloy, can be prevented to improve the shape accuracy of the flange. These flanges can be bonded with another member by a mechanical means or welding.

The L-shaped flange can be further bend at 90 degrees by hem bending (180° bending). In this case, the mold 15 is removed, and the plate-shaped current-carrying coil 17 is disposed above the L-shaped flange to supply electric energy in the downward direction, thereby forming a strong magnetic field in the L-shaped flange for a very short time. As a result, each of the substantially vertical sides of the flanges is deformed downward to perform hem bending. In this case, assuming that an automobile panel is formed, another aluminum alloy plate corresponding to an inner material may be placed on the aluminum alloy plate 16 used as an outer material, and the inner material may be held by deforming the flanges by hem bending to bond the outer and inner materials together.

Besides forming of the L-shaped flange, the electromagnetic forming of the metallic plate member may be applied to bending to a hat-like shape for a panel member or a portion to be formed into an elongated flange, for forming a flange by only the electromagnetic forming or a combination with ordinary press forming.

Figure 11A:
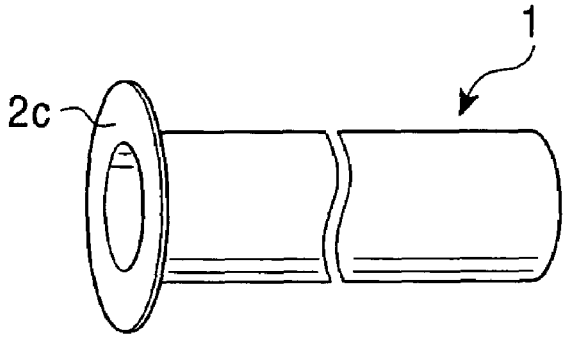
FIGS. 11A, 11B and 11C are perspective views showing examples of a flange of an aluminum alloy tube, which can be formed by the present invention.
Figure 11B:
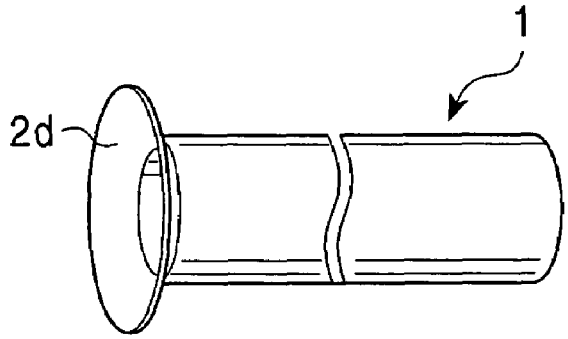
Figure 11C:
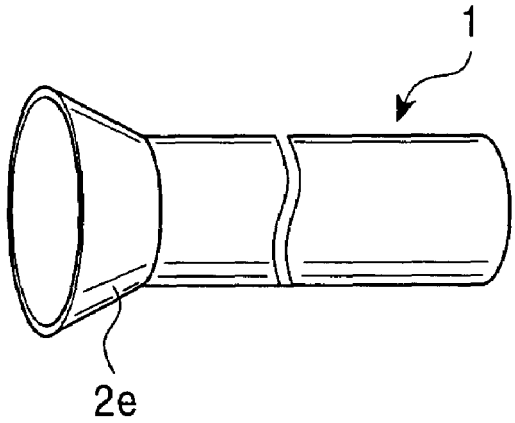

Also, in forming a flange in the tubular metallic member, a flange having a shape, for example, shown in FIGS. 11A, 11B or 11C may be contracted by using the current-carrying coil disposed around the flange to bend the widened portion of the flange at 180° and press the bent portion on the outer surface of the tubular member or incline the widened portion of the flange at 90° or more toward the outer surface of the tubular member. Therefore, the present invention can be applied not only to expansion for flange forming by electromagnetic forming but also to contraction by the electromagnetic forming, and can be combined with another known working method or forming method such as normal press forming, thereby further increasing the number of types which can be used in the present invention.

What is claimed is:

1. A method for electromagnetically forming a metallic member comprising deforming an end of a metallic member which is substantially at room temperature by instantly inputting an electromagnetic energy for plastic deformation, pressing the outer surface of the deformed end on the surface of a mold to form a flange having a predetermined shape at the end of the metallic member and, at the same time, to work-harden the flange, wherein the electric energy input is 8 kJ or more and is sufficient to plastically deform the metallic member maintained at or near room temperature.

2. The method for electromagnetically forming a metallic member according to claim 1, wherein the flange is formed and work-hardened by only one time of electromagnetic forming of the metallic member at a normal temperature.

3. The method for electromagnetically forming a metallic member according to claim 1, wherein the metallic member has a tubular shape, and the end of the metallic member is deformed by inputting an electric energy to a coil inserted into the end of the metallic member to expand the end of the metallic member, and the outer surface of the expanded end is pressed on the mold surface to form a flange having a predetermined shape at the end of the metallic member.

4. The method for electromagnetically forming a metallic member according to claim 1, wherein the metallic member has a wall thickness of 3 mm or more.

5. The method for electromagnetically forming a metallic member according to claim 3, wherein the tubular metallic member is disposed and fixed horizontally during electromagnetic forming.

6. The method for electromagnetically forming a metallic member according to claim 3, wherein a widened portion is formed at a back of the flange of the metallic member, and then work-hardened.

7. The method for electromagnetically forming a metallic member according to claim 1, wherein the metallic member is composed of an aluminum alloy.

8. The method for electromagnetically forming a metallic member according to claim 1, wherein the outer surface of the flange has a shape conforming with the shape of the outer surface of another metallic member to be joined to the metallic member.

9. The method for electromagnetically forming a metallic member according to claim 1, wherein the mold has a curved surface so that the formed flange has a curved surface.

10. A metallic member formed by an electromagnetic forming method according to claim 1, wherein the flange is formed by expanding an end of the metallic member and then work-hardening the expanded end.

11. A metallic member formed by an electromagnetic forming method according to claim 1, wherein the metallic member has a tubular shape.

12. A method for electromagnetically forming a metallic member, comprising the steps of:

positioning a metallic member at substantially room temperature in a mold having a forming surface, such that an end of the metallic member is adjacent the forming surface; and inputting a single pulse of electromagnetic energy at the end of the metallic member, the pulse of electromagnetic energy being sufficient for plastic deformation of the metallic member to expand and press an outer surface of the end of the metallic member onto the forming surface of the mold, thereby to form a flange having a predetermined shape at the end of the metallic member and, at the same time, to work-harden the flange, wherein said single pulse of electromagnetic energy is at least 8 kJ and is sufficient to plastically deform the metallic member maintained at or near room temperature.

13. A method for electromagnetically forming a metallic member comprising deforming an end of a metallic member by instantly inputting an electromagnetic energy for plastic deformation, pressing the outer surface of the deformed end on the surface of a mold to form a flange at the end of the metallic member, said flange having a shape conforming with a shape of an outer surface of another metallic member to be joined to the metallic member, at the same time, to work-harden the flange.

14. A method for joining metallic members comprising:

preparing a first metallic member;

preparing a second metallic member;

deforming an end of said first metallic member by instantly inputting an electromagnetic energy for plastic deformation;

pressing the outer surface of the deformed end on the surface of a mold to form a flange at the end of the first metallic member, said flange having a shape conforming with the shape of the outer surface of the second metallic member where said first metallic member is to be joined and, at the same time, to work-harden the flange; and joining said flange to the second metallic member so that the shape of said flange fits the shape of said second metallic member.

15. The method for joining metallic members according to claim 14, wherein said first and second metallic members are tubes.

* * * * *

UNITED STATES PATENT AND TRADEMARK OFFICE

CERTIFICATE OF CORRECTION

PATENT NO. : 6,968,718 B2
DATED : November 29, 2005
INVENTOR(S) : Imamura

It is certified that error appears in the above-identified patent and that said Letters Patent is hereby corrected as shown below:

Title page,
Item [73], Assignee, should read -- Kabushiki Kaisha Kobe Seiko Sho (Kobe Steel, Ltd.) Kobe (JP) --.

Signed and Sealed this

Thirty-first Day of January, 2006

JON W. DUDAS
*Director of the United States Patent and Trademark Office*